US007895135B2

(12) United States Patent
Norris et al.

(10) Patent No.: US 7,895,135 B2
(45) **Date of Patent: *Feb. 22, 2011**

(54) HUMAN PERCEPTION MODEL FOR SPEED CONTROL PERFORMANCE

(75) Inventors: William Robert Norris, Rock Hill, SC (US); Bernard Edwin Rornig, Illinois City, IL (US); John Franklin Reid, Moline, IL (US); Brian Joseph Gilmore, Geneseo, IL (US)

(73) Assignee: Deere & Company, Moline, IL (US)

( * ) Notice: Subject to any disclaimer, the term of this patent is extended or adjusted under 35 U.S.C. 154(b) by 555 days.

This patent is subject to a terminal disclaimer.

(21) Appl. No.: 11/673,638

(22) Filed: Feb. 12, 2007

(65) Prior Publication Data

US 2008/0195569 A1 Aug. 14, 2008

(51) Int. Cl.
*G06G 7/00* (2006.01)

(52) U.S. Cl. ..... 706/3; 706/52; 701/44; 701/98

(58) Field of Classification Search ..... 706/52, 706/1–9; 701/98, 44
See application file for complete search history.

(56) References Cited

U.S. PATENT DOCUMENTS 4,758,959 A * 7/1988 Thoone et al. ..... 701/221
5,163,530 A * 11/1992 Nakamura et al. ..... 180/197
5,358,317 A * 10/1994 Cikanek ..... 303/152
5,475,591 A 12/1995 Suzuki et al.
5,684,691 A * 11/1997 Orbach et al. ..... 700/56
5,704,200 A * 1/1998 Chmielewski et al. .... 56/10.2 E
5,863,105 A * 1/1999 Sano ..... 303/146
5,875,108 A * 2/1999 Hoffberg et al. ..... 700/17
5,899,288 A 5/1999 Schubert et al.
5,901,246 A * 5/1999 Hoffberg et al. ..... 382/209
5,940,814 A * 8/1999 Jiang et al. ..... 706/1
5,968,103 A 10/1999 Rocke
5,974,352 A 10/1999 Shull
5,983,161 A 11/1999 Lemelson et al.
6,038,505 A * 3/2000 Probst et al. ..... 701/65
6,041,320 A * 3/2000 Qin et al. ..... 706/1
6,064,933 A 5/2000 Rocke
6,070,118 A * 5/2000 Ohta et al. ..... 701/65
6,081,750 A * 6/2000 Hoffberg et al. ..... 700/17

(Continued)

OTHER PUBLICATIONS

Shoreshi, R.A. Intelligent Control Systems. Modern Control Systems by M.K. Masten, Lesson 10, 1995. p. 375-408.*

(Continued)

*Primary Examiner*—Michael B. Holmes
*Assistant Examiner*—David H Kim
(74) *Attorney, Agent, or Firm*—Yee & Associates, P.C.; Dawn C. Wolff

(57) ABSTRACT

A human perception model for a speed control method obtains a steering angle, a velocity error and a distance error. The steering angle and a measure of operator aggressiveness are applied to the model. The output is defuzzified. The steering angle, the velocity error and the distance error are applied to fuzzy logic membership functions to produce an output that is applied to a velocity rule base. The measure of operator aggressiveness is input to the velocity rule base. The output from the velocity rule base is defuzzified to produce a speed signal.

16 Claims, 11 Drawing Sheets

U.S. PATENT DOCUMENTS

| | | | | |
|---|---|---|---|---|
| 6,125,314 | A * | 9/2000 | Graf et al. | 701/53 |
| 6,188,945 | B1 * | 2/2001 | Graf et al. | 701/58 |
| 6,208,981 | B1 * | 3/2001 | Graf et al. | 706/2 |
| 6,223,117 | B1 * | 4/2001 | Labuhn et al. | 701/93 |
| 6,226,389 | B1 | 5/2001 | Lemelson et al. | |
| 6,233,515 | B1 * | 5/2001 | Engelman et al. | 701/96 |
| 6,317,686 | B1 * | 11/2001 | Ran | 701/210 |
| 6,321,153 | B1 | 11/2001 | Rocke et al. | |
| 6,353,785 | B1 * | 3/2002 | Shuman et al. | 701/48 |
| 6,385,519 | B2 | 5/2002 | Rocke | |
| 6,430,506 | B1 | 8/2002 | Mon et al. | |
| 6,442,463 | B1 | 8/2002 | Qiu et al. | |
| 6,480,768 | B1 | 11/2002 | Torii | |
| 6,487,477 | B1 * | 11/2002 | Woestman et al. | 701/22 |
| 6,487,500 | B2 | 11/2002 | Lemelson et al. | |
| 6,553,130 | B1 | 4/2003 | Lemelson et al. | |
| 6,584,382 | B2 | 6/2003 | Karem | |
| 6,615,126 | B1 * | 9/2003 | Potter et al. | 701/84 |
| 6,735,515 | B2 * | 5/2004 | Bechtolsheim et al. | 701/208 |
| 6,813,562 | B2 * | 11/2004 | Altan et al. | 701/301 |
| 6,836,719 | B2 | 12/2004 | Andersson et al. | |
| 6,906,639 | B2 | 6/2005 | Lemelson et al. | |
| 6,925,425 | B2 * | 8/2005 | Remboski et al. | 702/188 |
| 7,039,551 | B2 * | 5/2006 | Shu et al. | 702/182 |
| 7,124,027 | B1 * | 10/2006 | Ernst et al. | 701/301 |
| 7,178,819 | B2 | 2/2007 | Scherl et al. | |
| 7,263,419 | B2 * | 8/2007 | Wheals et al. | 701/36 |
| 7,359,770 | B2 | 4/2008 | Cole | |
| 7,389,178 | B2 * | 6/2008 | Raz et al. | 701/200 |
| 7,561,054 | B2 * | 7/2009 | Raz et al. | 340/576 |
| 7,769,512 | B2 | 8/2010 | Norris et al. | |
| 2002/0120371 | A1 * | 8/2002 | Leivian et al. | 701/1 |
| 2003/0065432 | A1 * | 4/2003 | Shuman et al. | 701/48 |
| 2003/0135290 | A1 * | 7/2003 | Yao et al. | 700/50 |
| 2003/0171869 | A1 * | 9/2003 | Potter et al. | 701/84 |
| 2003/0217021 | A1 | 11/2003 | Jacobson | |
| 2004/0158371 | A1 * | 8/2004 | Iggulden et al. | 701/29 |
| 2005/0149240 | A1 * | 7/2005 | Tseng et al. | 701/38 |
| 2005/0197994 | A1 * | 9/2005 | Fujii et al. | 706/59 |
| 2005/0273240 | A1 * | 12/2005 | Brown et al. | 701/70 |
| 2006/0080022 | A1 * | 4/2006 | Hrovat et al. | 701/82 |
| 2006/0200258 | A1 * | 9/2006 | Hoffberg et al. | 700/86 |
| 2006/0253240 | A1 * | 11/2006 | Rao et al. | 701/48 |
| 2007/0005212 | A1 * | 1/2007 | Xu et al. | 701/70 |
| 2007/0083318 | A1 * | 4/2007 | Parikh | 701/96 |
| 2008/0086248 | A1 * | 4/2008 | Lu et al. | 701/41 |
| 2008/0195293 | A1 | 8/2008 | Norris et al. | |

OTHER PUBLICATIONS

W. R. Norris, et al. A Design Tool for Operator-Adaptive Steering Controllers. American Society of Agricultural Engineers. vol. 46(3): 883-891. Jun. 2003.*

Jamshidi et al. Fuzzy logic and control: software and hardware applications. Ed. Barbara Martine. PTR Prentice-Hall, Upper Saddle River, NJ. 1993, Chap 1.*

Norris et al, A Novel Real-Time Human Operator Performance Model for Performing Adaptive System Design, Automation Technology for Off-Road Equipment, Proceedings of the Jul. 26-27, 2002 Conference, pp. 287-306, Jul. 26, 2002.*

Norris et al. Rule-Base Reduction for a Fuzzy Human Operator Performance Model. Applied Engineering in Agriculture, vol. 22(4) pp. 611-618, Jul. 2006.*

Ackermann and Bunte. Automatic Car Steering Control Bridges over the Driver Reaction Time. Academy of Sciences of the Czech Republic. vol. 33, No. 1, pp. 61-74. 1997.*

Filla, Reno et al. "Dynamic Simulation of Construction Machinery: Towards an Opertor Model." NCFP 105-11.5. p. 429-438.

Filla, Reno et al. "Using Dynamic Simulation in the Development of Construction Machinery." The Eighth Scandinavian International Conference on Fluid Power, SICFP'03, May 7-9, 2003, Tampere, Finland.

Singh, Sanjiv, "The State of the Art in Automation Earthmoving." ASCE Journal of Aerospace Engineering. vol. 10, #4, Oct. 1997.

Larsson, Jonas, "Concepts for Multi-Domain Simulation with Application to Construction Machinery." 2001, Linkoping Studies in Science and Technology. Thesis No. 870. Institute of Technology, Linkopings Universitet, Division of Fluid and Mechanical Engineering Systems, Department of Mechanical Engineering, Linkopings Universitet, SE-581 83 Linkoping, Sweden.

Ericsson, Allan et al. "Mechanical Dynamics: A model for predicting digging forces when working in gravel or other granulated material." 15:th ADAMS European Users Conference, p. 1-9, 2000, Rome.

Norris, William R. et al. "Hierarchical Rule-Base Reduction For A Fuzzy Logic Based Human Operator Performance Model."

Norris, William R. "Disclosures."

* cited by examiner

HUMAN PERCEPTION MODEL FOR SPEED CONTROL PERFORMANCE

FIELD OF THE INVENTION

The present invention relates to a method of speed control, and, more particularly to a human perception model for use in the speed control of a vehicle.

BACKGROUND OF THE INVENTION

Automatic control of complex machinery, such as moving vehicles exists, for example, the control systems for aircraft autopilots. Just as a man-machine interface is required for the man to control the machinery an automation of the control system is largely specific to the particular machinery that is to be controlled. For example, pilots, even after extensive training on a particular aircraft, do not qualify for piloting a similar aircraft, without extensive training on the alternate aircraft.

Agricultural machinery has become more expensive and complex to operate. Traditionally, human machine control has been limited to open-loop control design methods, where the human operator is assumed to receive appropriate feedback and perform adequate compensation to ensure that the machines function as required and to maintain stable operation. Design methods have included using an expert operator and fine-tuning the control with non-parametric feedback from the operator in terms of verbal cues. These approaches do not always translate to the best quantitative design or overall human-machine synergy.

Assuming that an individual expert operator is the only method of ensuring qualitative response presents several problems. One problem with this assumption is that humans are not the same, with varying perceptions, experience, reaction time, response characteristics and expectations from the machine. The result may be a perceived lack in the qualitative aspects of the human machine interface for some operators. The task of designing optimal human-machine system performance without a consistent operator becomes a daunting one, as there are no methods for settling appropriate constraints. Additionally, expert operators are themselves different in terms of level of efficiency, aggressiveness and sensitivity. Expert operators adapt very quickly to machine designs, including inadequate ones. The result is that qualitative design change effectiveness is not guaranteed since they are applied based on an operator's continuously adapting perception of the machine performance.

What is needed is an operator model that provides the ability to address design issue variables including response fidelity, accuracy and noise from sensory information, response time, and control set points based on aggressiveness and mission requirements.

SUMMARY OF THE INVENTION

The present invention provides a human perception model for the speed control of a vehicle.

The invention comprises, in one form thereof, a human perception model for a speed control method including the steps of obtaining a steering angle, a velocity error and a distance error. The method further includes the steps of applying the steering angle, inputting a measure of operator aggressiveness and defuzzifying an output. The applying step includes applying the steering angle, the velocity error and the distance error to fuzzy logic membership functions to produce an output that is applied to a velocity rule base. The inputting step inputs a measure of operator aggressiveness to the velocity rule base. The defuzzifying step defuzzifies an output from the velocity rule base to produce a speed signal.

DETAILED DESCRIPTION OF THE INVENTION

Figure 1:
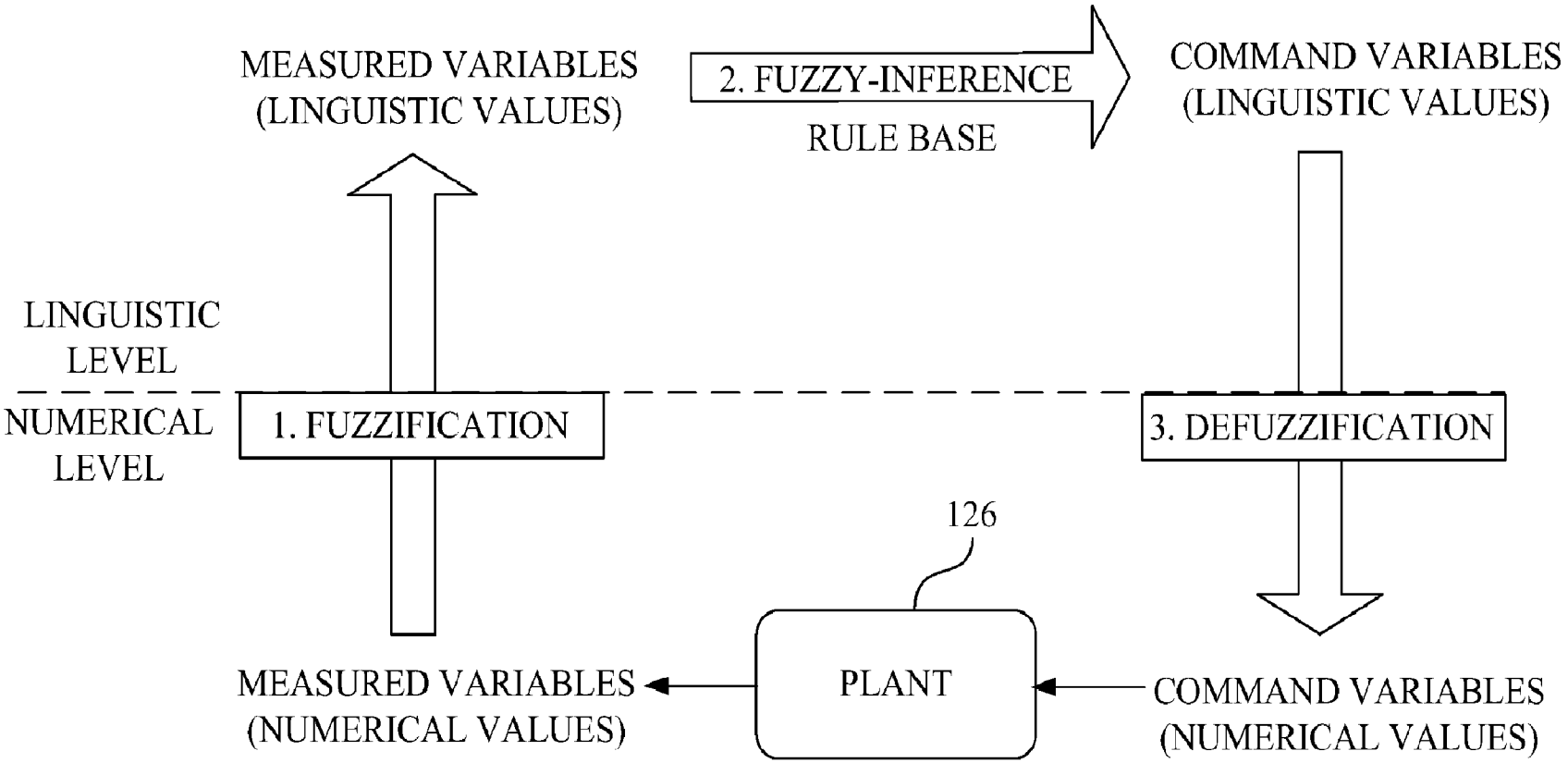
Fig. 1 (PRIOR ART)
FIG. 1 is a schematic illustration of the use of fuzzy logic in an embodiment of the method of the present invention.
Figure 2:
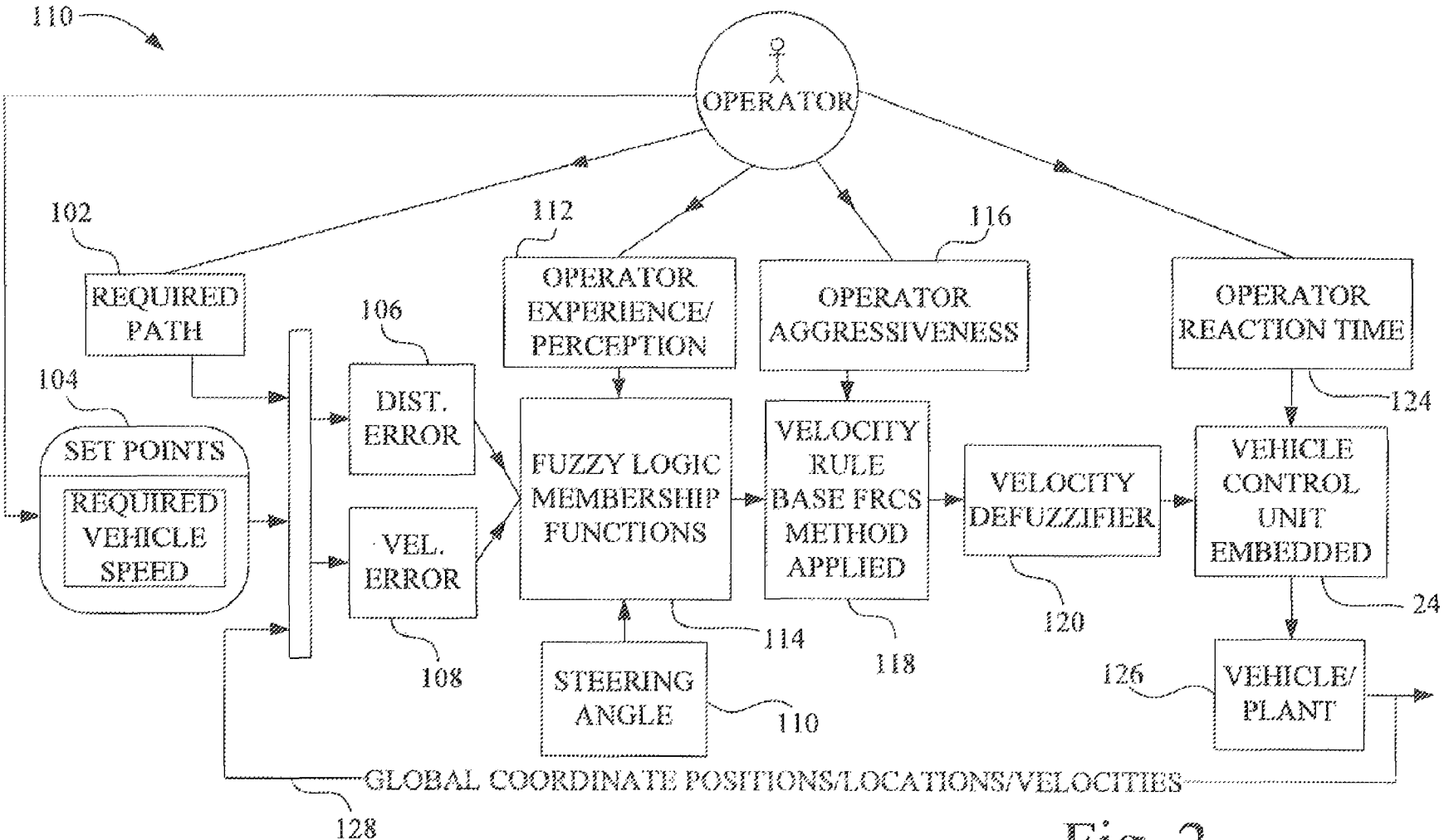
FIG. 2 schematically illustrates an embodiment of a human perception model of the present invention for the speed control of a vehicle.

Referring now to the drawings, and more particularly to FIGS. 1 and 2, there are shown schematic illustrations of an approach used in an embodiment of a method of the present invention. The goal is to approximate human operator performance characteristics, which is undertaken by the use of a fuzzy logic controller structure. The design of the virtual operator proceeds in the following sequence and includes the fuzzification of the input variables, the application of the variables to a fuzzy inference and rule base construction and the defuzzification of the output variables. The fuzzification step converts control inputs into a linguistic format using membership functions. The membership functions are based on the outputs from an error interpreter. The input variables to the model include several performance related measurable items. To reduce computational effort, linear approximations are implemented. A fuzzy membership function for the various linguistic variables are chosen to be pi-type or trapezoidal in nature.

As illustrated in FIG. 1, measured variables having numeric values are fuzzified into a linguistic format. A fuzzy-inference of these fuzzified variables is made by the application of a rule base resulting in command variables having a fuzzy format. These command variables are then defuzzified by converting the command variables to a numeric value that is interfaced with the control system of the vehicle plant. The vehicle responds causing a change in the location of the vehicle, which creates new measured variables based on the new location, and the method continues.

Figure 3:
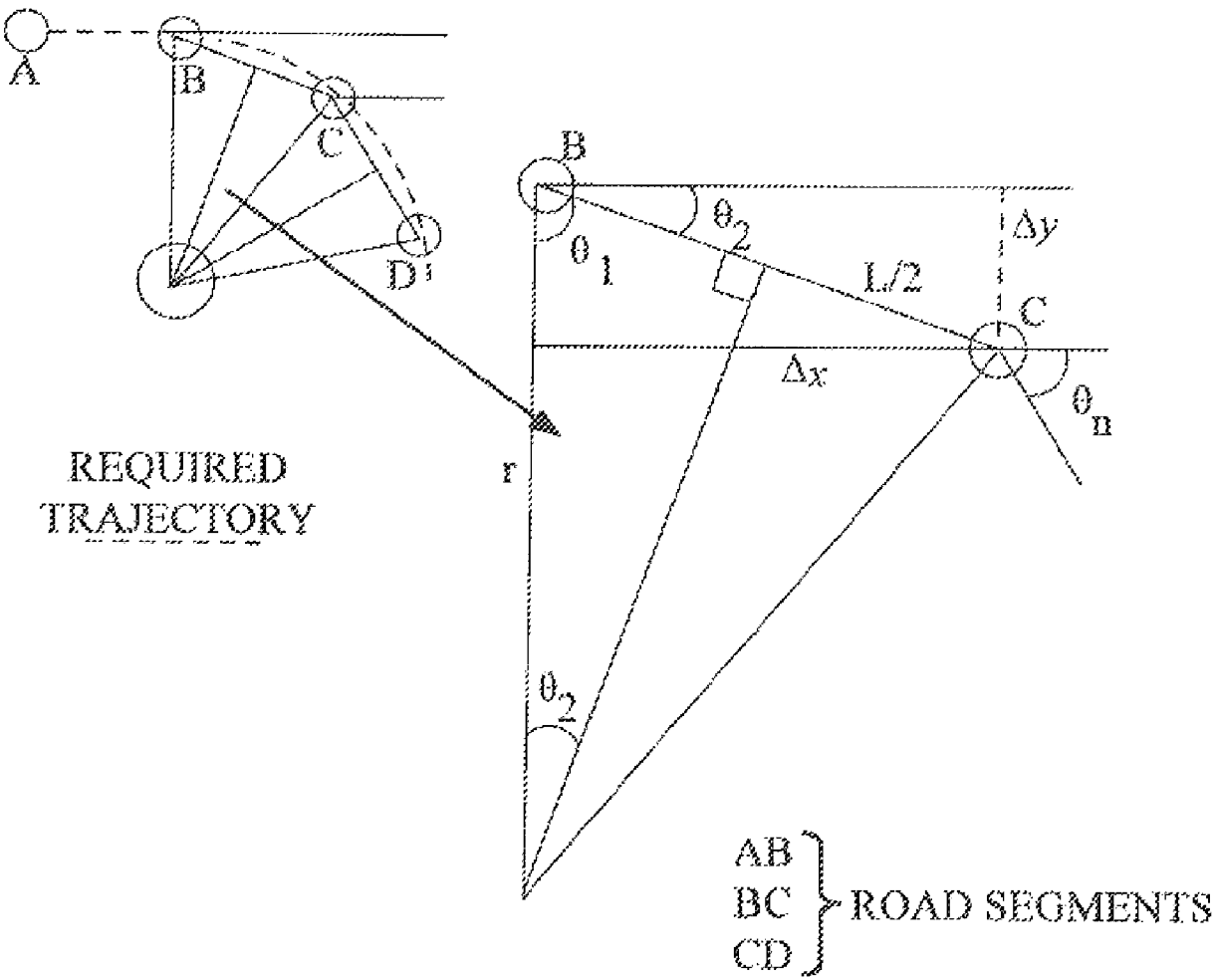
FIG. 3 illustrates a path of the vehicle of FIG. 2 along a preferred path.
Figure 4:
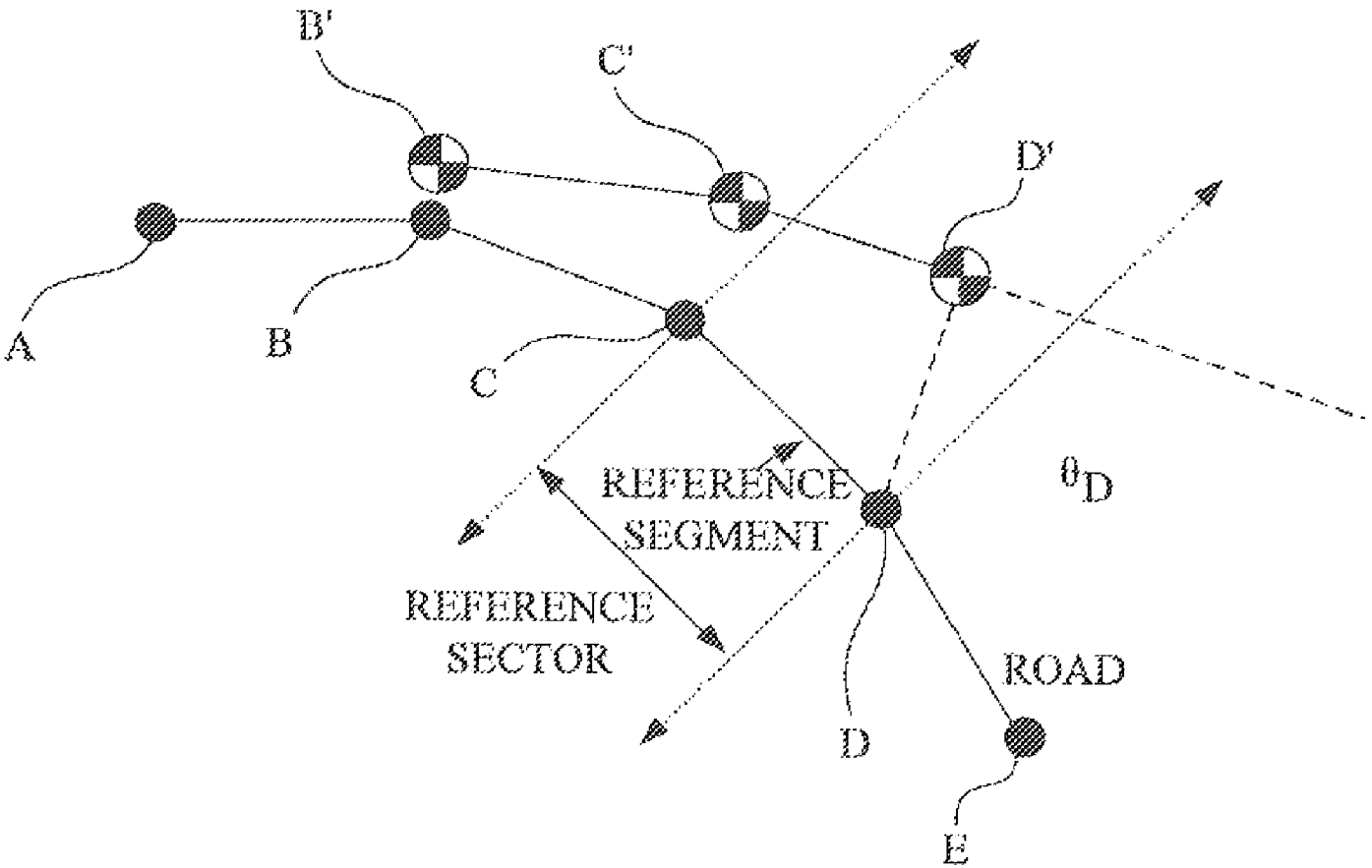
FIG. 4 illustrates a front angle error of the vehicle of FIG. 2 relative to a preferred course.

Now, additionally referring to FIGS. 3 and 4, the approach used for the operator model applies fuzzy logic to perception based modeling. This human model is developed for the purpose of a speed control function. When provided a path or segment, such as segments BC and CD, as shown in FIG. 3, it can be modeled as linear segments, arcs or clothoids and provides illustrations of the errors related to the control objective of following the path parallel to the trajectory at a minimum distance. The problem becomes multi-objective when the vehicle:

(1) Has initial conditions where the vehicle is outside of a given distance from the road or its heading varies from the path heading by a large degree.

(2) Deviates from the path by a large amount and similar error conditions arise either from obstacles or high speeds with dynamic changes resulting from such things as lateral slip.

(3) The current steering angle of the vehicle may result in a roll over based on the vehicle speed or potential for severe lateral slip.

As a result three errors are used as inputs to the operator model. The operator model is dependent on the errors, but independent of the method used to detect the errors or the set points. The three inputs are the distance error, the velocity error and the steering angle. For ease of reference herein, the steering angle will be referred to as an error even though it may otherwise not be thought of as such.

When a vehicle is traveling from B' to C' the distance from C to C' is larger than the distance from B to B' indicating that the vehicle is departing from the desired path of ABCDE. Further, the vehicle will depart farther at D-D'. This illustrates that the control system would undertake a correction to reduce the difference and control the speed in so doing. It can be seen in FIG. 4 that the speed may need to be increased in the solution since the location of D' is farther from the referenced sector line than C-C'. Again the present invention uses the distance error, the velocity error and the steering angle as inputs in determining the necessary correction in speed of the vehicle.

Now, additionally referring to FIGS. 5-9, the operator model of the present invention is dependent on the errors, but independent of the method used to detect the errors or the set points. The errors are selected based on driver behavior and the difference between the current speed and the set point, the distance from the vehicle to the road and the current steering angle. Steering angle is included to help modulate the speed control to help reduce effects of lateral slip and reduce the risk of roll over.

The controller is constructed as a rate controller, controlling the rate of speed correction given a particular error. The rules involved that are used by methods of the present invention may include the following rules:

If the error is large, increase the rate of correction.

If the error is small, reduce the rate of correction.

If the error is acceptable, take no corrective action.

Rate control has an advantage relative to human operator modeling and is very applicable for several reasons:

(1) It will work on a variety of platforms, independent of vehicle geometry, with little modification and will work independent of set points. It is dependent on a max rate of turn and sampling rates.

(2) It effectively models how most operator controls work, such as joysticks.

(3) It emulates how human operators control vehicle speed while maintaining a consistent steering control throughout a turn.

(4) The effects of discontinuities are reduced as each control action is discretely based on the current errors.

The control strategy for the system demonstrates the multi-objective nature of the controller. Like a human, certain errors can be disregarded depending on where the vehicle is located relative to where it has to go. For example, if the vehicle is far away from the path, the intent is to approach the path as soon as possible. If the vehicle continues to depart from the path then the speed should approach zero. If the steering angle is large, the speed should decrease to mitigate lateral slip and potential roll over. The decisions have to be made around the optimal/mission speed set points. Using the method known as fuzzy relation control strategy (FRCS) the rule base is minimized in this control strategy.

The operator model addresses the fidelity of the response, accuracy and noise from sensory information, response time, control set points based on aggressiveness and mission requirements, output scaling is based on operator aggressiveness, and operator experience, perception and judgment. The model addresses these elements through the use of applied gains and changes to the membership function linguistic variables.

Figure 5:
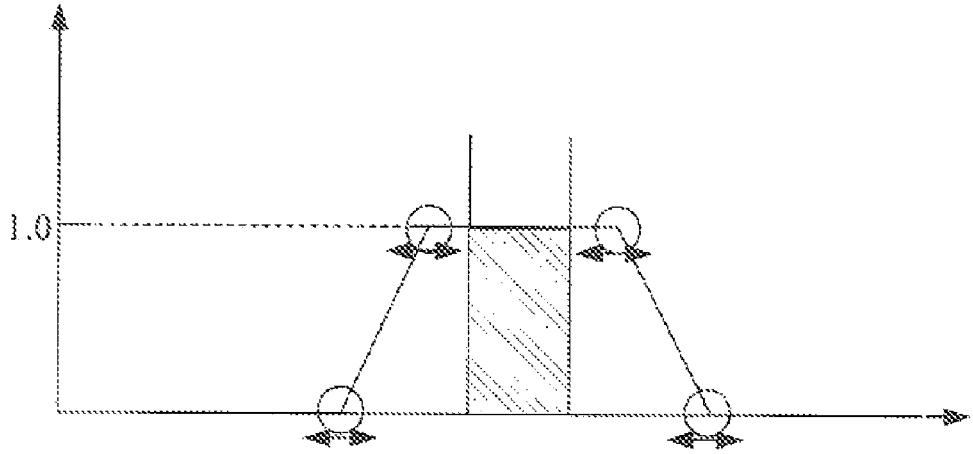
FIG. 5 schematically illustrates a rule used by the performance model of the present invention.
Figure 6:
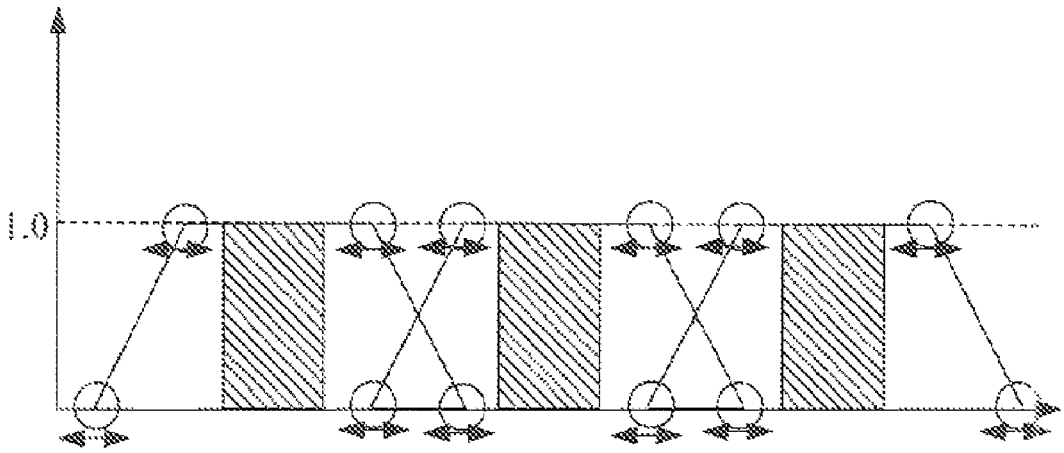
FIG. 6 illustrates the application of several rules used by the performance model of the present invention.
Figure 7:
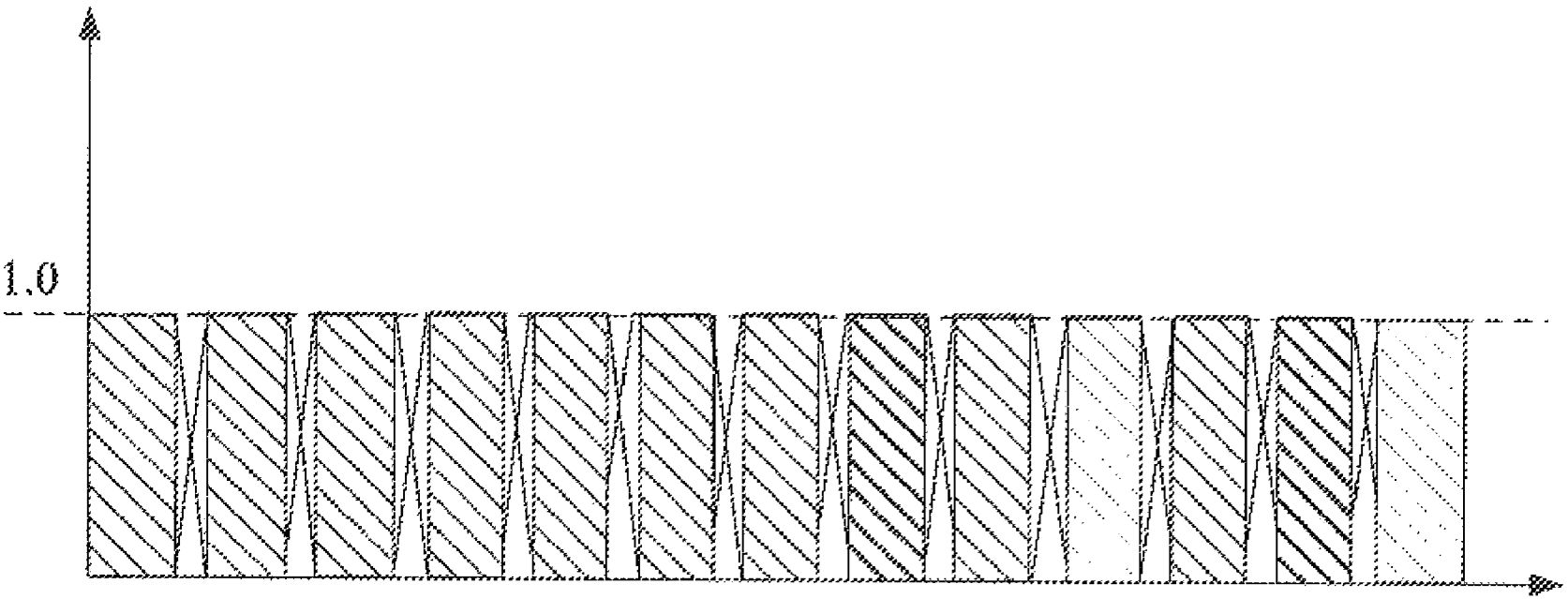
FIG. 7 illustrates even more certainty by the including of rules in the performance model of the present invention.

The membership functions of the fuzzy system represent how the model interprets error information. Trapezoidal membership functions, such as those shown in FIGS. 5-7 represent regions where the operator is certain of an interpretation, or error classification. Trapezoids are used in FIGS. 5-7 to provide a visual illustration of the membership functions. For a human operator it is almost impossible to measure error exactly, even more so for an inexperienced operator. A regional approach to error classification is most applicable to the present invention. For example, a human operator cannot determine that the vehicle is traveling exactly at 5 meters/second unless he uses some direct measurement of the speed. However, depending on the situation, he can determine he is traveling very fast and away from the path. What is uncertain is where very fast changes to a fast classification or where the transition region between classifications of errors occurs. These transitions are illustrated as angled portions of the trapezoids. A triangular, or a Gaussian distribution with a small standard deviation, membership function by itself is inappropriate in this approach. However, continuing with the regional approach, experience/judgment can be incorporated and represented in two ways. The first is an increase in the number of linguistic variables, or perception granularity, depending on the fidelity required for adequate control. The second aspect is that smaller transition regions between the linguistic variable error classifiers improve system performance. Inexperience and errors in interpreting the information are represented in this model by linguistic variables with extended transition regions such as that shown in FIGS. 5 and 6 and/or by shifting the regions covered by the linguistic variables. This model lends itself very well to interpreting the inexact common noisy data from sensors as well as describing how humans make control decisions with uncertain information. The model uses a common sense rule base that remains unchanged, except in the event of improved perception granularity, where additional rules using the same control strategy would have to be applied. The response fidelity, perception, operator experience, accuracy, noise from sensory information and judgments are represented and are modifiable. Control set points can be changed without effecting the controller operations using gains based on the operator level of aggressiveness and mission requirements. An output can also be scaled based on operator aggressiveness as the current system provides a signal between one and minus one. The output component of the rules within the rule base can also be modified to provide a more aggressive output.

In FIGS. 5-7 the region of certainty under all situations is illustrated by the shaded box. As the situation changes it shifts away from the region of certainty there is a decreasing likelihood that the rule is going to be effective, as illustrated by the sloped lines. In FIG. 6 as more rules are introduced, as compared to FIG. 5, there is less possibility of an uncertain circumstance. Further, more experience and/or a larger knowledge base, there is more interpretation and response granularity, that yields smaller, less fuzzy transition regions between the rules, as illustrated in FIG. 7.

Figure 8:
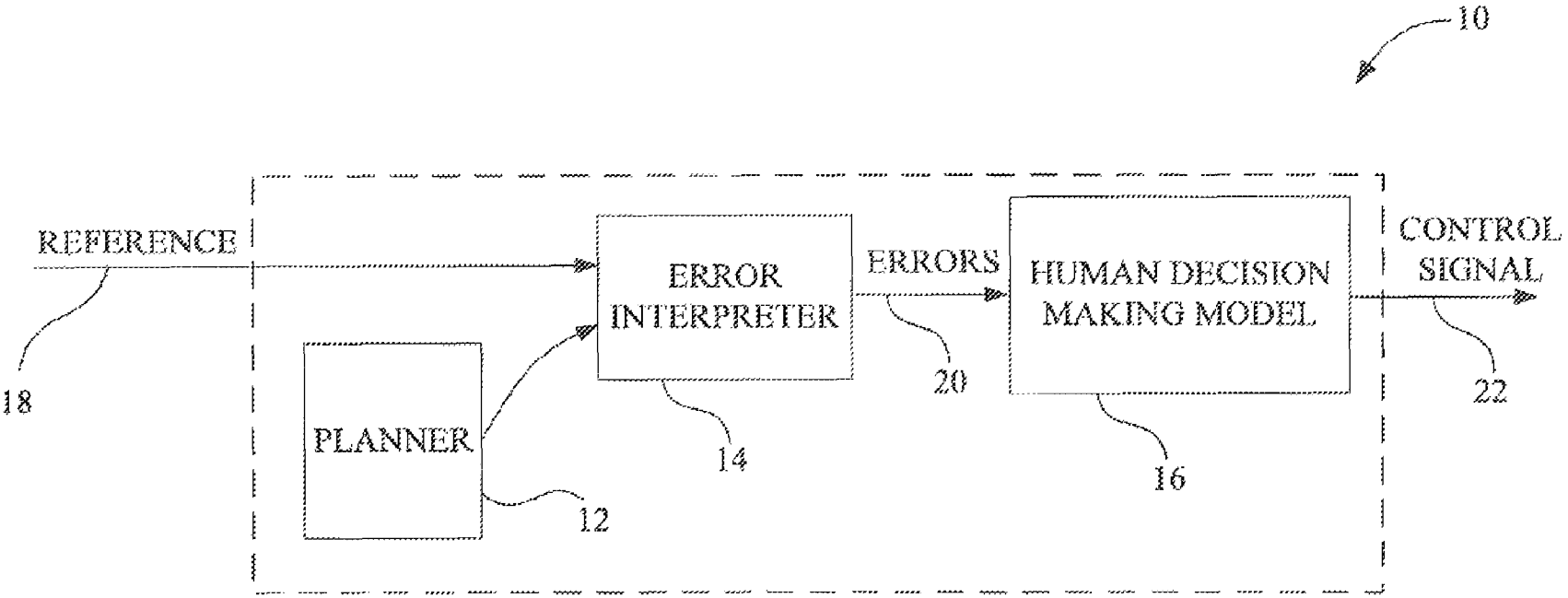
FIG. 8 is a schematic illustration of a human performance model of the present invention.

FIG. 8 schematically illustrates a performance model 10 including a planner portion 12, an error interpreter 14, and a human decision-making model 16. A reference signal 18, as well as set points from planner 12, are utilized by error interpreter 14 to generate errors such as distance error, velocity error and it also utilizes current steering angle information. Error interpreter 14 generates errors 20 that are used by human decision-making model 16 to produce a control signal 22. Control signal 22 in this instance relates to the speed of the vehicle.

Figure 9:
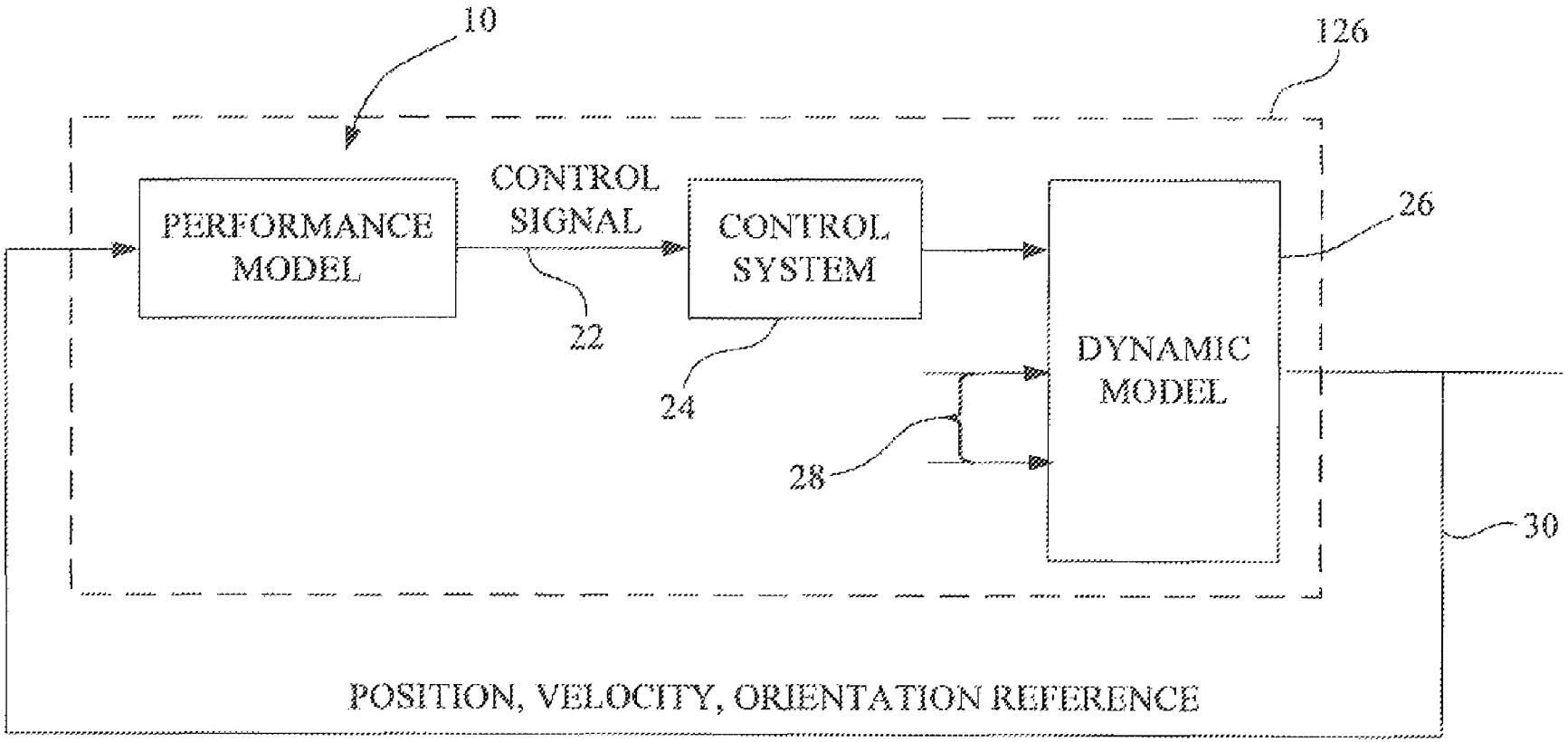
FIG. 9 schematically illustrates a vehicle utilizing the performance model of FIG. 8.

In FIG. 9 performance model 10 feeds control system 24 a control signal 22. Control system 24 provides input into dynamic model 26. Dynamic model 26 may include other inputs 28 other than speed information, such as steering information that may be input on other inputs 28. An output signal from dynamic model 26 is generated and a feedback reference signal 30, which feeds back to reference signal 18, indicates the position, velocity, acceleration and orientation of the vehicle.

As illustrated in FIG. 2, a method 100 obtains information from an operator that include a required path 102 and set points necessary to alter the vehicle speed at 104. A distance error 106, a velocity error 108, a steering angle 110 and operator experience/perception 112 all serve as inputs to fuzzification portion 114. Fuzzification portion 114 utilizes velocity membership functions to interpret the inputs to generate output information for use in velocity rule base 118. Operator aggressiveness 116 is also input into rule base 118, the output thereof is provided to velocity defuzzifier 120 that results in an input signal to a vehicle control unit 122. Vehicle control unit 122 also has an operator reaction time input in order to calculate an output signal to control vehicle 126. The position, velocity, acceleration and orientation of vehicle 126 is sensed and fed back as a reference by a feedback loop 128.

Blocks 102 and 104 correspond to planner 12 of FIG. 4. The distance error 106, velocity error 108 and steering angle 110 are utilized as inputs to an error interpreter 14. Operator experience/perception 112, operator aggressiveness 116 and operator reaction time 124 are set by a gain control as described previously. Distance error 106 and velocity error 108 are determined from mathematical combinations of the information from feedback loop 128 and from the required path 102 and set points 104.

Human perception provides an inexact estimation of error. Exact error measurements are not possible by a human; however, humans can readily determine if an error is acceptable, close or far away from an objective based upon experience. Boundaries between error classifications are where the uncertainty occurs. The trapezoidal representation incorporates the imprecise classification in their transitional sloped areas. The flat areas at the top of the trapezoids represent a region of certainty.

The membership function parameters used in block 114 are tuned to minimize the maximum distance variation from a given trajectory at an optimal or near optimal speed. The tuned membership functions for example can have three linguistic variables in an attempt to minimize computational effort. When additional granularity in the membership functions is needed it can be introduced if necessary. For example, using variables of "too fast", "too slow" and "acceptable speed" easily illustrates the linguistic variables that are common to a human operator and are utilized by method 100.

The rule base is derived based on heuristic knowledge. A hierarchal technique is used based on the importance of the inputs relative to their linguistic variable regions. The hierarchy is drawn from the controller objects. The object for the fuzzy logic controller is to provide a speed signal to bring the vehicle to a desired path. In order to incorporate the information, a fuzzy relations control strategy (FRCS) is utilized. The error values are then fuzzy relations control variables (FRCVs). The FRCS applies to an approach with a control strategy that is incorporated into the fuzzy relations between the controller input variables. The FRCS is developed because the problem is multi-objective, where the current object depends on the state of the system and it results in a different control strategy. The control strategy is to minimize the distance from a trajectory in as short a time as possible, to avoid lateral slip and to avoid roll over the vehicle. The current steering angle of the vehicle incorporated as block 110 is input into fuzzification portion 114 to classify the steering angle. If the vehicle distance is far from a required path and the primary objective is to approach the required path as quickly as possible without spending excessive control energy, the vehicle speed may be an acceptable value that is higher than an acceptable value when the vehicle closely approaches the required path. As such, the definition of acceptable speed is different when the vehicle is a far distance from the required path than it is when the vehicle is a short distance from the path.

The FRCS employed in forming the rule base includes a complete set of control rules for all speed conditions. The size of the rule base is generally reduced by approximately 98% by ignoring the extra rules irrelevant to the control strategy.

Defuzzifying the output of rule base method 118 occurs at step 120 to derive a non-fuzzy or crisp value that best represents the fuzzy value of the linguistic output variable. One method that can be utilized is known as the center of area technique to result in a discrete numeric output.

Figure 10A:
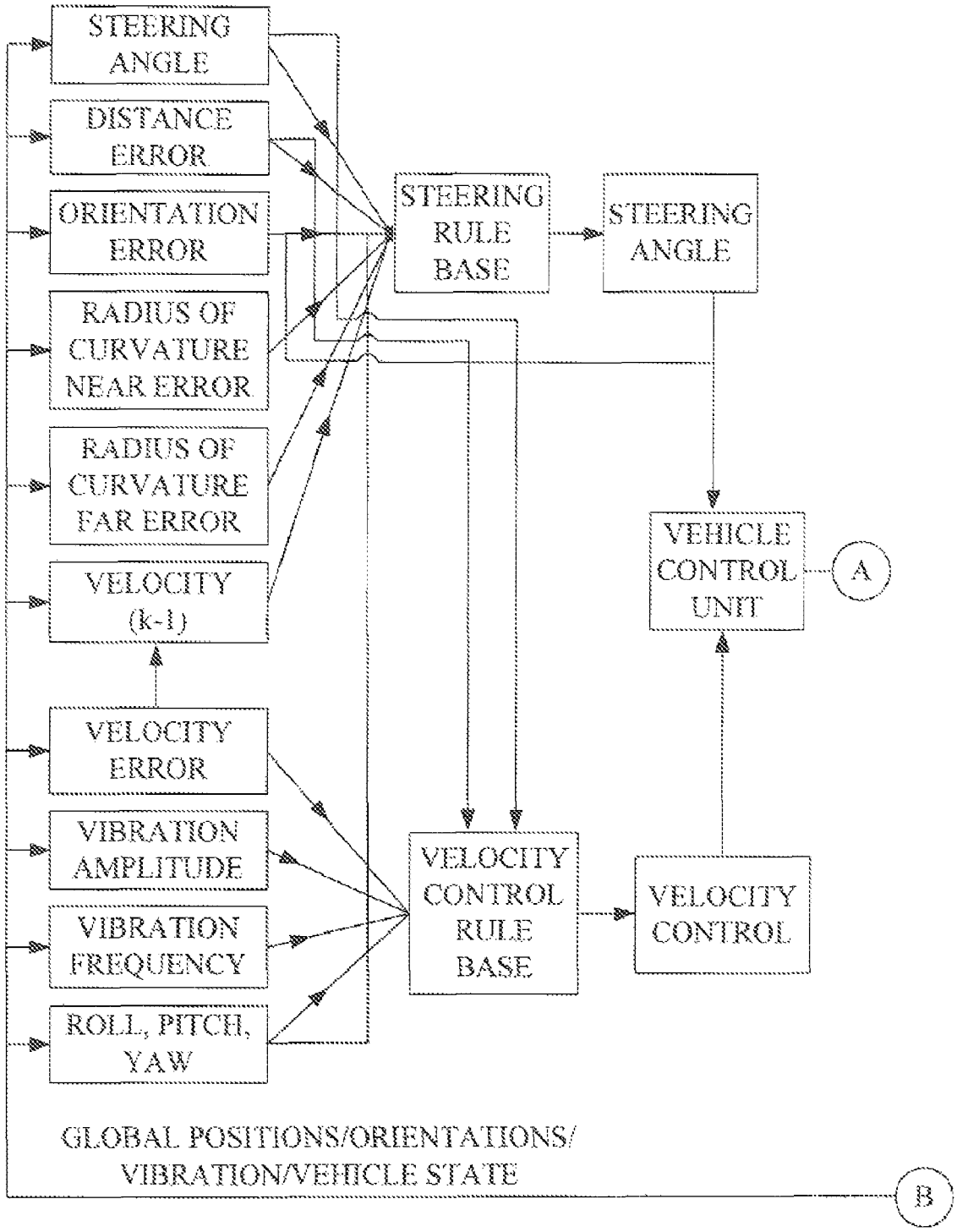
FIG. 10A-10C schematically illustrates another embodiment of a fuzzy control system of the present invention.
Figure 10B:
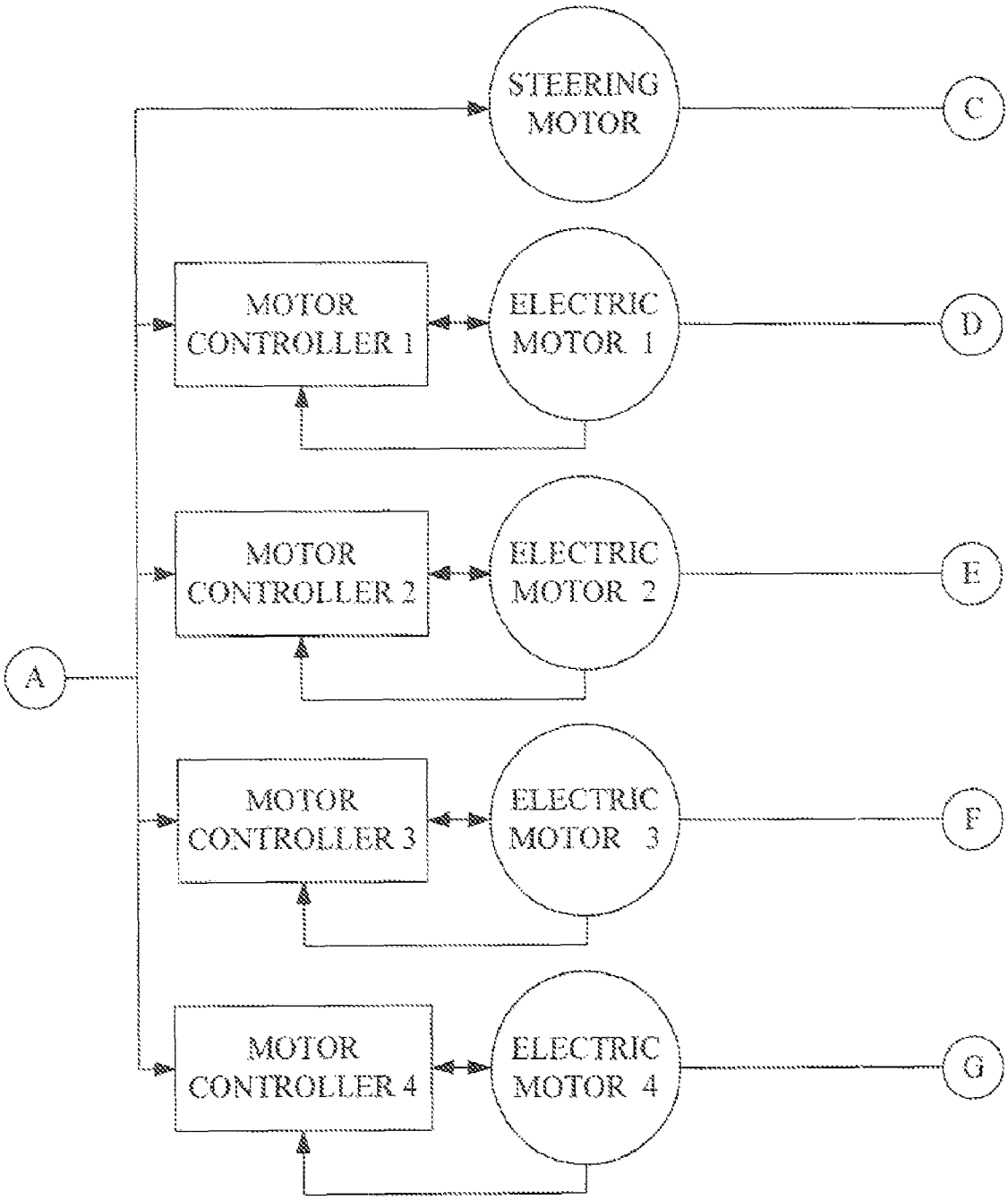
Figure 10C:
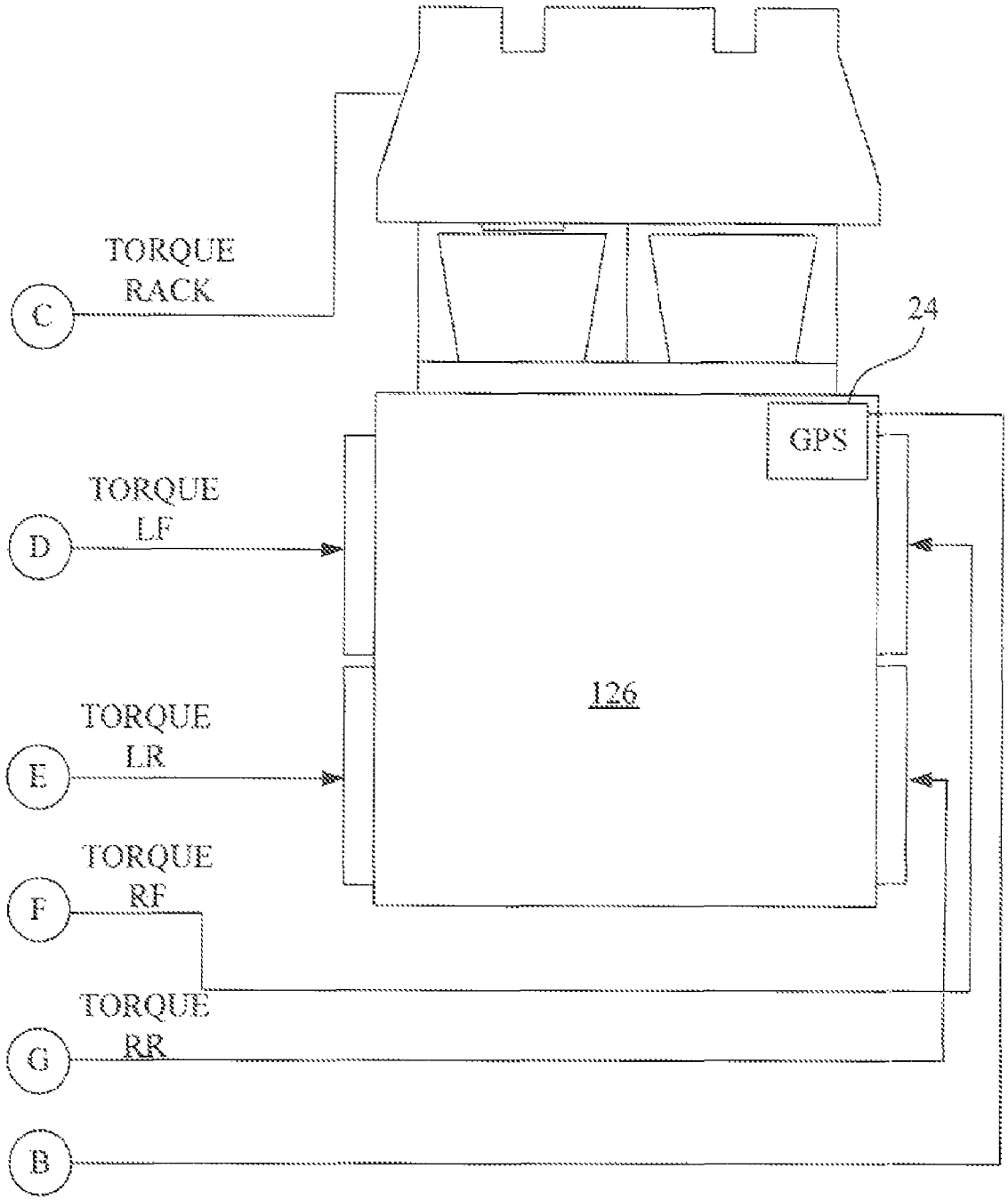

Now, additionally referring to FIGS. 10A-10C, there is illustrated another embodiment of the present invention including inputs to both steering and velocity fuzzy control rules bases that result in vehicle control signals that are interpreted and applied to each of four drive motors and a steering motor. The vehicle schematically illustrated has four drive wheels that are independently speed controlled and a steering motor that is used to guide the steering mechanism of the vehicle. Inputs, in addition to those discussed above, are used in this fuzzy rule base system, such as vibration amplitude, vibration frequency and the roll, pitch and yaw of the vehicle. Although shown in a schematic form apart from vehicle 126 it is to be understood that the elements depicted in FIGS. 10A and 10B are normally functionally located on vehicle 126. The model can also be used apart from a vehicle for simulation purposes.

The human perception model for speed control results in a qualitative optimization of the man-machine interface and a synergy between the operator and the machine. Additionally, it allows for a stability analysis for a wide range of operator behaviors since the gains of the inputs can be set to alter the experience and aggressiveness of the operator. The model allows for an optimization of the machine/control system to minimize energy consumption of the machine components based on a wide variety of operator behavior patterns. The human perception model results in an understanding of differences between operators, including varying efficiencies. This advantageously allows virtual rapid prototyping of control systems. The present invention leads to the development of autonomous, operator assisted, tele-operation, operator augmentation algorithms and human-machine interfaces. Additionally, the human operator model allows for understanding in determining of feed back requirements for drive-by-wire systems. Yet still further, the human perception model allows for development of sophisticated individual and personalizable operator controls and system response characteristics, thereby improving operator/machine synergy.

Having described the preferred embodiment, it will become apparent that various modifications can be made without departing from the scope of the invention as defined in the accompanying claims.

The invention claimed is:

1. A human perception model for a speed control method, comprising the steps of:

obtaining, by a vehicle control system, a steering angle;

obtaining, by the vehicle control system, a velocity error;

obtaining, by the vehicle control system, a distance error, wherein the distance error is a difference between a required path and a determined actual location;

establishing the required path which serves as an input to said obtaining a distance error step;

establishing required vehicle speed set points as an input to said obtaining a distance error step;

applying, by the vehicle control system, said steering angle, said velocity error and said distance error to fuzzy logic membership functions to produce an output that is applied to a velocity rule base;

inputting, by the vehicle control system, a measure of operator aggressiveness to said velocity rule base; and defuzzifying, by the vehicle control system, an output from said velocity rule base to produce a speed signal.

2. The method of claim 1, further comprising the step of receiving said speed signal by a vehicle control unit.

3. The method of claim 2, further comprising the step of inputting an operator reaction time to said vehicle control unit.

4. The method of claim 1, further comprising the step of changing set points dependent on said distance error.

5. The method of claim 4, further comprising the step of using operator experience/perception information by said fuzzy logic membership functions.

6. The method claim 1, wherein said establishing the required path step also serves as an input to said obtaining a velocity error step.

7. The method of claim 1, wherein said establishing required vehicle speed set points step also serves as an input to said obtaining a velocity error step.

8. The method of claim 7, further comprising the step of obtaining at least one of an orientation, a location and a velocity to input to at least one of said obtaining a velocity error step and said obtaining a distance error step.

9. A human perception model for a speed control method, comprising the steps of:

applying, by a vehicle control system, a steering angle, a velocity error and a distance error to fuzzy logic membership functions to produce an output that IS applied to a velocity rule base, wherein the distance error is a difference between a required path and a determined actual location;

establishing the required path which serves as an input to obtain said distance error;

establishing required vehicle speed set points as an input to obtain said distance error;

inputting, by the vehicle control system, a measure of operator aggressiveness to said velocity rule base; and defuzzifying, by the vehicle control system, an output from said velocity rule base to produce a speed signal.

10. The method of claim 9, further comprising the step of receiving said speed signal by a vehicle control unit.

11. The method of claim 10, further comprising the step of inputting an operator reaction time to said vehicle control unit.

12. The method of claim 9, further comprising the step of changing set points dependent on said distance error.

13. The method of claim 12, further comprising the step of using operator experience/perception information by said fuzzy logic membership functions.

14. The method of claim 9, wherein said establishing the required path step also serves as an input to obtain said velocity error.

15. The method of claim 9, wherein said establishing required vehicle speed set points step also serves as an input to obtain said velocity error.

16. The method of claim 15, further comprising the step of obtaining at least one of an orientation, a location and a velocity to input to obtain said velocity error and said distance error.

* * * * *

UNITED STATES PATENT AND TRADEMARK OFFICE

CERTIFICATE OF CORRECTION

PATENT NO. : 7,895,135 B2
APPLICATION NO. : 11/673638
DATED : February 22, 2011
INVENTOR(S) : William Robert Norris et al.

It is certified that error appears in the above-identified patent and that said Letters Patent is hereby corrected as shown below:

Title Page item 75

Bernard Edwin Rornig; should be Bernard Edwin Romig

Signed and Sealed this
Twenty-second Day of November, 2011

David J. Kappos

David J. Kappos
*Director of the United States Patent and Trademark Office*